US008256581B2

(12) United States Patent
Nowel

(10) Patent No.: US 8,256,581 B2
(45) Date of Patent: Sep. 4, 2012

(54) LANDING DOOR PROXIMITY WARNING SYSTEM

(75) Inventor: Edward J. Nowel, Columbia, NJ (US)

(73) Assignee: Inventio AG, Hergiswil (CH)

( * ) Notice: Subject to any disclaimer, the term of this patent is extended or adjusted under 35 U.S.C. 154(b) by 428 days.

(21) Appl. No.: 12/570,425

(22) Filed: Sep. 30, 2009

(65) Prior Publication Data

US 2011/0073416 A1 Mar. 31, 2011

(51) Int. Cl.
*B66B 1/34* (2006.01)

(52) U.S. Cl. ..... 187/391; 187/316

(58) Field of Classification Search ..... 187/247, 187/313, 314, 316, 391–393, 396; 340/541, 340/545.1, 565; 49/26, 28
See application file for complete search history.

(56) References Cited

U.S. PATENT DOCUMENTS

| | | | | |
|---|---|---|---|---|
| 6,173,814 | B1 * | 1/2001 | Herkel et al. | 187/288 |
| 6,339,375 | B1 * | 1/2002 | Hirata et al. | 340/541 |
| 6,550,585 | B2 * | 4/2003 | Schoppa et al. | 187/391 |
| 6,591,947 | B2 * | 7/2003 | Horbrugger et al. | 187/393 |
| 6,603,398 | B2 * | 8/2003 | Tinone et al. | 340/541 |
| 6,707,374 | B1 * | 3/2004 | Zaharia | 340/5.31 |
| 6,945,363 | B2 * | 9/2005 | Angst et al. | 187/317 |
| 7,140,469 | B2 * | 11/2006 | Deplazes et al. | 187/316 |
| 7,140,470 | B2 * | 11/2006 | Azpitarte | 187/317 |
| 7,448,473 | B2 * | 11/2008 | Lindberg et al. | 187/392 |
| 7,954,606 | B2 * | 6/2011 | Tinone et al. | 187/384 |
| 2008/0230326 | A1 * | 9/2008 | Tyni et al. | 187/393 |
| 2011/0114422 | A1 * | 5/2011 | Kattainen et al. | 187/301 |

FOREIGN PATENT DOCUMENTS

| | | | |
|---|---|---|---|
| JP | 02255483 A | * | 10/1990 |
| WO | 96/35630 | | 11/1996 |

* cited by examiner

*Primary Examiner* — Anthony Salata

(74) *Attorney, Agent, or Firm* — Wolff & Samson, PC

(57) ABSTRACT

A security system for an elevator has a car position sensor, which is adapted to determine if a car is at a landing. The security system further has an indicator, which is located at the landing. The indicator is adapted to emit a warning signal if the car is not at the landing.

10 Claims, 2 Drawing Sheets

LANDING DOOR PROXIMITY WARNING SYSTEM

BACKGROUND OF THE INVENTION

The invention relates to an elevator security system, in particular a warning system for passengers in proximity of landing doors.

An elevator is usually mounted in a shaft of a building. Along such a shaft, there are a number of landings allowing access to the shaft from different floors of the building. The elevator includes a car, a counterweight, a load bearing member, a drive unit, and landing doors. The car and the counterweight are movably suspended in the shaft. The load bearing member is associated with the car, the drive unite, and the counterweight. The drive unit drives the load bearing member and, thus, moves the car and the counterweight in the shaft up and down in opposite directions.

The elevator is configured to stop at landings such that passengers can enter or leave the car. Unless a car is positioned at a landing, the landing doors are closed and prevent passengers from entering the shaft. A certain landing door only opens if the car is positioned correctly behind that landing door and if a passenger requested to enter or leave the car at that landing door. In most elevators, the car has a car door which only opens if an adjacent landing door opens. Usually the car door and the adjacent landing door are coupled such that only one door drive is necessary, and that the car door and the landing door open simultaneously.

Even though the landing doors prevent passengers from entering the shaft when the car is not positioned correctly behind a certain landing door, fatal entries through landing doors into the shaft occur. In many elevators, landing doors can be opened from the landing with a key, for example, with a three-square socket wrench. Technicians need to enter the shaft for revision or for maintenance of the elevator, but anybody having a suitable key at hand can enter the shaft from the landing.

In order to prevent unauthorized entries, WO 96/35630 A1 discloses an elevator landing door monitoring system. At least one detector is positioned on the elevator shaft at a respective location generally opposite each landing door without direct contact therewith. If the monitor detects that the landing door is open and no car is present, the monitor produces an alarm signal. The alarm signal is sent to a control circuit that takes the elevator out of service and generates audible and visual alarms.

Even with elevator landing door monitoring systems as described in WO 96/35630 A1, fatal entries through landing doors occur.

SUMMARY OF THE INVENTION

It is therefore an object of this invention to further develop the above described elevator landing door monitoring system. It is further an object of this invention to provide an elevator security system that helps to reduce fatal entries through landing doors.

Accordingly, one aspect involves a security system for an elevator. The security system includes a car position sensor, which is adapted to determine if a car is at a landing. The security system further includes an indicator, which is located at the landing. The indicator is adapted to emit a warning signal if the car is not at the landing.

In one embodiment the security system may further include a landing door sensor adapted to determine if a landing door is closed. The indicator may accordingly be adapted to emit the warning signal while the landing door is closed.

In one embodiment, the security system may further include a sensor adapted to determine if a person is in a detection area. The indicator may accordingly be adapted to emit the warning signal if a person is in the detection area.

Another aspect involves a method for warning passengers approaching an elevator landing door if an unsafe situation exists. The method includes determining if a car is at a landing, and emitting a warning signal at a landing at which the car is not present while a landing door at the landing is closed.

In one embodiment, the method further includes detecting if a passenger is in a detection area. The method further includes emitting a warning signal at a landing at which the car is not present if the passenger is in the detection area. The method may further include detecting a sojourn time of the passenger in the detection area, whereas the alarm is only emitted if the sojourn time of the passenger in the detection area exceeds a certain duration.

An additional aspect involves a method for indicating an unsafe situation at elevator landing doors. The method includes determining if a car is at a landing, and displaying an indication signal indicating the unsafe situation at least at one landing at which the car is not present. The indication signal may be displayed if the landing door is closed.

BRIEF DESCRIPTION OF THE DRAWINGS

The invention is described in detail with respect to specific embodiments thereof, these embodiments being illustrative only and in no way restrictive as to how the invention may be practiced. Reference is made to the drawings where.

DETAILED DESCRIPTION OF THE INVENTION

Figure 1:
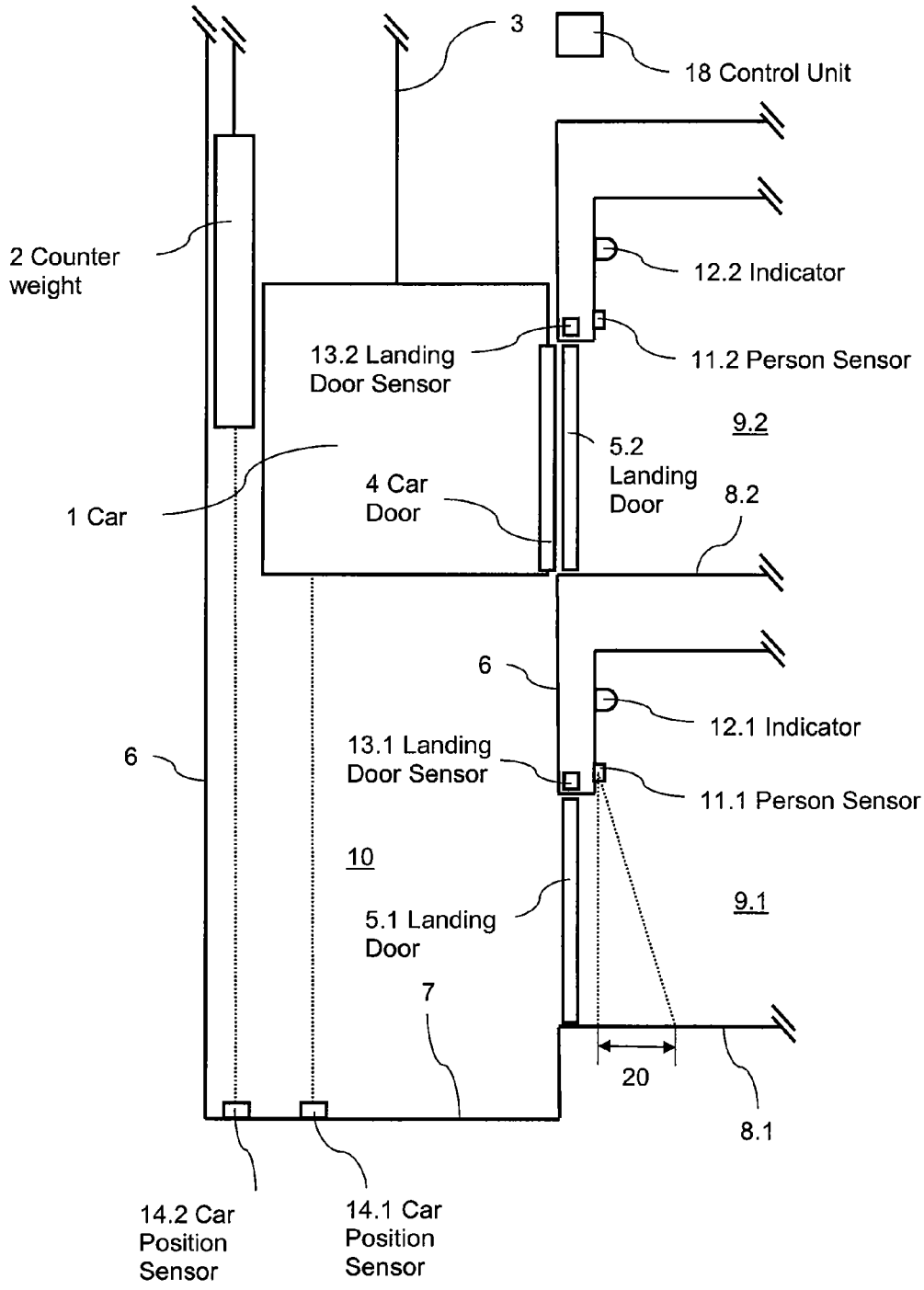
FIG. 1 is a schematic drawing showing an elevator, wherein a car is positioned at a landing door.

FIG. 1 shows an elevator associated with a building and having a car 1, a counterweight 2, and a load bearing member 3. The car 1 and the counterweight 2 are suspended on the load bearing member 3. The car 1 and the counterweight 2 can move upwards and downwards in a shaft 10. The shaft 10 is bounded by a shaft floor 7 and shaft walls 6.

FIG. 1 further shows a lower landing 9.1 and an upper landing 9.2. Each landing has a landing floor 8.1, 8.2 and a landing door 5.1, 5.2. The car 1 is positioned at the upper landing 9.2. In this exemplary embodiment, the car 1 has a car door 4. The car door 4 and the upper landing door 5.2 are adjacent to each other such that they can be opened simultaneously in order to allow passengers to enter or leave the car 1.

The elevator in FIG. 1 is a schematic representation which does not show all components of an elevator. The person skilled in the art will appreciate that several possible arrangements of an elevator exist: For example, the number of landings may be varied from two to one hundred or more, depending on the number of floors of the corresponding building. The arrangement of the car 1 and the counterweight 2 in the shaft 10 can be varied. There can be more than one car 1 in the same shaft 10. The car 1 and the counterweight 2 can be suspended on the load bearing member 3 directly or on pulleys. The car 1 can be configured without a car door 4. The present invention is therefore not limited to one specific configuration of an elevator. This invention is applicable to almost any kind of elevator that has landing doors 5.1, 5.2.

A security system for the elevator has at least one car position sensor 14.1, 14.2 and at least one indicator 12.1, 12.2. The security system may further have at least one person sensor 11.1, 11.2 and/or at least one landing door sensor 13.1, 13.2. Each of these components of the security system may be configured as a single unit, or as two or more units of the same kind. Hereinafter, the various components of the system are described with reference to the embodiment in which these components are configured as a single unit (e.g., "person sensor 11" instead of "at least one of the person sensors 11.1, 11.2").

As shown in the exemplary embodiment of FIG. 1, the car position sensor 14 is located in a shaft pit on the shaft floor 7. The car position sensor 14.1 measures a distance from the shaft floor 7 to the car 1, and the car position sensor 14.2 measures a distance from the shaft floor 7 to the counterweight 2. As the load bearing member 3 has a defined length, it is possible to calculate the position of the car 1 if the position of the counterweight 2 is known. Therefore, either the position of the car 1 or the position of the counterweight 2 can be measured in order to determine the position of the car 1 in the shaft 10.

In one embodiment, the car position sensor 14 includes an ultrasonic-based distance sensor. In an alternative embodiment, the car position sensor 14 has a laser-based distance sensor.

Instead of measuring the distance, as shown in FIG. 1, a number of alternative ways to determine a car position can be employed. For example, a drive unit (not shown) can continuously register a number of revolutions of a drive pulley in either direction and thus a position of the car can be calculated at all times.

In a further alternative embodiment, a sensor detects codes integrated in the load bearing member 3. With a respective key, each code in the load bearing member 3 can be allocated to a position of the car.

According to another alternative embodiment, there are multiple sensors along a guide rail of the car 1 and/or along the guide rail of the counterweight 2. By analyzing which one of the multiple sensors yields a positive signal, a position of the car 1 in the shaft 10 can be determined.

According to yet another alternative embodiment, a sensor is associated with a speed governor. As the speed governor is coupled to the movement of the car 1, a car 1 position in the shaft 10 can be determined by detecting a number of revolutions of a speed governor pulley.

Instead of one car position sensor 14, two car position sensors of a different kind can be used. This allows for a redundant determination of the car position, which increases the reliability of the security system.

The skilled person will appreciate that it is sufficient to determine if a car is at a certain landing or not. Therefore, it is not necessary to detect the exact position of the car. The car position sensors 14.1, 14.2 may accordingly be adapted to cover only areas of the landings 9.1, 9.2 in the elevator shaft 10. For this purpose, one car position sensor 14 can be located at each landing 9 in order to determine if the car 1 is at a certain landing 9. According to one embodiment, the car 1 has a reflective material strip that is recognized by an optical reader of the car position sensors 14 at each landing 9. Alternatively, the car position sensors 14 at each landing 9 may, e.g., employ radar sensors or magnetic sensors.

The person sensor 11, as shown in the exemplary embodiment of FIG. 1, is located in the landing 9 above the landing door 5. The person sensor 11 observes a detection area 20 which is located in front of the landing door 5. A detection area 20 extends from the person sensor 11 to the landing floor 8. In a preferred embodiment, the person sensor 11 is configured such that a person interferes with the detection area 20 before that person is able to reach to the landing door 5.

In one embodiment the person sensor 11 includes an ultrasonic or laser based distance sensor. In an alternative embodiment the person sensor 11 includes a motion sensor.

In an alternative embodiment, the person sensor 11 can be located at the landing floor 8 or at a side wall of the landing door 5 or at a ceiling of the landing 9.

Instead of the person sensor 11 described above, a number of alternative embodiments of a person sensor can be employed. According to one such alternative embodiment, the person sensor 11 includes a light barrier. A light emitting element is arranged at a first side of the detection area 20, and a light receiving element is arranged at a second side of the detection area 20, opposite to the first side. If the detection area 20 is clear, the light emitted from the light emitting element is at least partially received by the light receiving element. If an object is between the light emitting element and the light receiving element, less light will reach the light receiving element. The intensity of light received by the light receiving element can thus be used to determine whether an object is in the detection area 20 or not.

It is not necessary that the detection area 20 reaches from above the landing door 5 to the landing floor 8. In some embodiments it may be sufficient to monitor only at certain heights, for example, between 0.5 meters and 2.0 meters above the landing floor 8. A distance between the landing door 5 and an outer limit of the detection area 20 at which an approaching passenger first enters the detection area 20 can be chosen according to safety requirements.

A first function of the person sensor 11 is to detect whether a person or an object are present in the detection area 20 or not. An additional function of the person sensor 11 is to detect for how long an object or passenger sojourns in the detection area 20.

The person skilled in the art will appreciate that the person sensor 11 detects not only persons but also other objects entering the detection area 20, such as a box or an animal. The term "person sensor", as used herein, indicates that the main purpose of this sensor is to detect persons that need to be warned about an unsafe condition, but the person sensor detects other objects as well.

The indicator 12, as shown in the exemplary embodiment of FIG. 1, is located in the landing 9 above the landing door 5. The indicator 12 is adapted to indicate if it is safe to approach the landing door 5 or not. The indicator 12 is further adapted to emit a warning signal if the car 1 is not at the landing 9 while a landing door 5 is closed.

In one embodiment, the indicator 12 is configured to output optical signals such as colored light, flash light, or light with different light intensity. In an alternative embodiment, the indicator 12 is configured to output acoustic signals such as a signal tone, an alarm sound at different rates, or different melodies. The indicator 12 can also use a combination of visual and acoustic components.

In addition to visual and/or acoustic warning signals, the indicator 12 in a further embodiment is configured to output specific voice announcement according to the present location of a passenger and/or according to a position of the car 1 and/or according to a condition of the landing door 5.

A function of the indicator 12 is to indicate to a person approaching the landing door 5 whether or not it is safe to get in close proximity of the landing door 5.

As shown in FIG. 1, the security system in this exemplary embodiment further includes at least one landing door sensor 13.1, 13.2. The landing door sensor 13 is located in or close to the landing door 5 and detects whether or not the landing door 5 is properly closed.

In a first embodiment, the landing door sensor 13 is positioned adjacent to the landing door 5. If the landing door 5 is properly closed, the landing door sensor 13 detects a first code positioned on the landing door 5. In that case, the sensor generates a "closed" signal indicative of a closed landing door 5. If the landing door 5 is not properly closed, the landing door sensor 13 detects a second code positioned on the landing door 5. In that case, the landing door sensor generates a "not closed" signal indicative of a not properly closed landing door 5.

In an alternative embodiment, the landing door sensor 13 is integrated in a landing door lock. A bistable switch changes from a first position "door locked" to a second position "door unlocked" when the bistable switch is operated. In this case, the landing door sensor 13 does not determine whether or not the landing door 5 is open, but it indicates whether or not the landing door lock is locked or unlocked. Depending on the security requirements of the elevator, either embodiment may be chosen.

In a further alternative embodiment, the landing door sensor 13 is located on a shaft wall 6 generally opposite the landing door 5. In this embodiment, the landing door sensor 13 includes an acoustic-based or light-based distance sensor that is positioned at the shaft wall 6 and adapted to emit and receive signals traveling across the shaft 10, from the sensor 13 towards the landing door 5 and back to the sensor 13. Such a landing door sensor 13 detects whether or not the landing door 5 is closed, and it also detects whether or not the car 1 or the counterweight 2 is at a landing 9 at which the landing door sensor 13 is positioned. Accordingly, such a landing door sensors 13 can replace a separate landing door sensor 13 located in proximity of the landing door 5 and a car position sensor 14.

Figure 3:
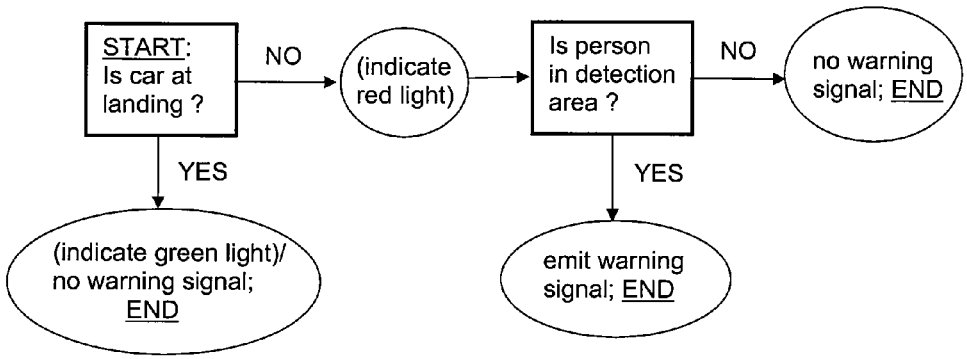
FIG. 3 is a schematic flow chart of a method for indicating an unsafe situation at an elevator landing door.

The exemplary security system for the elevator shown in FIG. 1 further includes a control unit 18. The control unit 18 is coupled to the car position sensor 14, to the person sensor 11, to the landing door sensor 13, and to the indicator 12. The control unit 18 is configured to process input signals coming from the sensors 14, 11, 13, and to generate signals that activate the indicator 12 according to a predetermined program. An exemplary flow chart for such a program is shown in FIG. 3 described below.

In an alternative embodiment, each landing 9 has its own local circuitry that connects the sensors 14, 11, 13 with the indicator 12. A program that determines in which conditions of the sensors 14, 11, 13 a warning signal is triggered can be identical or different at each landing 9. If safety requirements are identical at each landing floor 8, then identical programs and circuitry can be used. If one or more landing floors 8 have different safety requirements, e.g., because children or blind people use such a specific floor more frequently, different programs and circuitry can be used for this specific floor.

Figure 2:
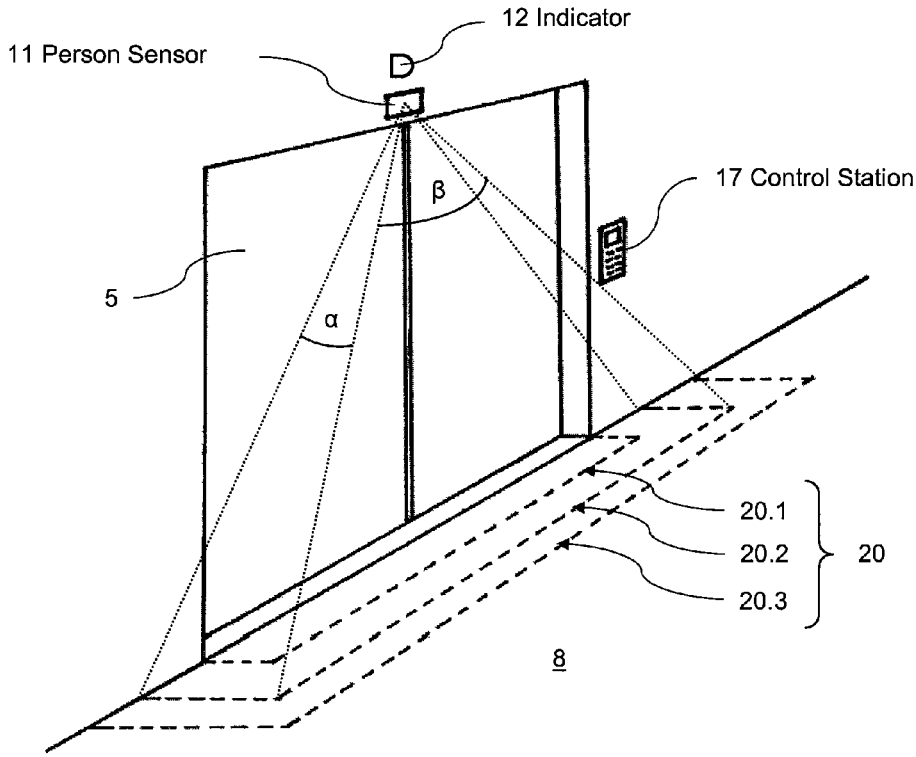
FIG. 2 is a schematic drawing showing a landing door with a person sensor and detection areas.

FIG. 2 shows an exemplary landing door 5, as seen from the landing, wherein the landing door 5 is closed. A control station 17 adapted to register calls from waiting passengers is located beside the landing door 5. The indicator 12 is located above the landing door 5.

The person sensor 11 is located above the landing door 5, and adapted to determine if a person is in the detection area 20. The detection area 20 extends from the person sensor 11 to the landing floor 8, thus forming a pyramidal area with an apex at the person sensor 20 and a base on the landing floor 8.

In this exemplary embodiment, the detection area 20 has three distinct detection areas: a first detection area 20.1, a second detection area 20.2, and a third detection area 20.3. The first detection area 20.1 is fully contained in the second detection area 20.2, and the second detection area 20.2 is fully contained in the third detection area 20.3. The first detection area 20.1 covers the area closest to the landing door 5, whereas the second and third detection areas 20.2, 20.3 in addition cover areas further away from the landing door 5. In FIG. 2, detection angles $\alpha$, $\beta$ are chosen such that the second detection area 20.2 is formed.

In order to form multiple detection areas 20.1, 20.2, 20.3, the person sensor 11 may have multiple sensors, each with different detection angles $\alpha$, $\beta$. In an alternative embodiment, the person sensor 11 has one sensor that is adapted to vary its detection angles $\alpha$, $\beta$ according to a predetermined scheme. For example, the detection angles $\alpha$, $\beta$ may be changed several times each second such that each detection area 20.1, 20.2, 20.3 is formed at least once each second.

The person skilled in the art will appreciate that the detection area 20 may have a shape different from the pyramidal area as shown in FIG. 2. In an alternative exemplary embodiment, the detection area 20 is cone-shaped, whereas only one detection angle is varied to form multiple detection areas 20.1, 20.2, 20.3.

In one exemplary embodiment, a passenger approaching the landing door 5 enters at first the third detection area 20.3. Only if he moves closer to the landing door 5, the passenger also enters the second detection area 20.2 and eventually the first detection area 20.1.

The indicator 12 emits different warning signals depending on the sojourn time and on the detection area 20.1, 20.2, 20.3 in which the passenger is detected, according to safety requirements of the elevator.

For example, if the passenger enters only detection area 20.3, it may not be necessary to emit any acoustic warning signals. It may be sufficient to indicate, for example, with a low intensity red light, that it is not safe to approach the landing door 5 any further if there is no car behind the landing door 5.

If the passenger enters the second detection area 20.2, it may be necessary to emit a gentle acoustic warning signal and or to indicate with a medium intensity red light that it is not safe to approach the landing door 5 any further if there is no car behind the landing door 5.

If the passenger enters the first detection area 20.1, it may be necessary to emit an acoustic warning signal and or to indicate with an intense red light that it is not safe to stay longer in the first detection area 20.1 if there is no car behind the landing door 5.

In addition to detecting which detection area 20.1, 20.2, 20.3 has been entered by the passenger, a sojourn time of the passenger in one particular detection area is measured. If the sojourn time exceeds a predetermined duration in a respective detection area 20.1, 20.2, 20.3, the warning signal is emitted. In one embodiment, the threshold of the sojourn time is between 1 and 20 seconds, preferably between 2 and 15 seconds, most preferably between 3 and 10 seconds.

FIG. 3 shows an exemplary flow chart of a method for indicating an unsafe situation at an elevator landing door. This process may be carried out for each landing individually.

The first step of the process is to determine if the car is at the landing. This step is carried out by the car position sensor. If the car is at the landing for which the process is carried out, then it is safe to approach the landing door. Accordingly, a green light may be indicated by the indicator, and no warning signal is emitted. In this case, no further steps have to be taken.

If the car is not present at the landing for which the process is carried out, then it is not safe to approach the landing door. Accordingly, a red light may be indicated by the indicator. The second step of the process is then to determine if a person is in the detection area. If no person is in the detection area, there is no need to emit a warning signal, and no further steps have to be taken.

If there is a person in the detection area, a warning signal is emitted in order to indicate to the person in the detection area that it is not safe to stay close to the landing door while the car is not behind that landing door.

It is clear to the person skilled in the art that there are many ways to notify a passenger of a safe or an unsafe situation. Therefore, the example given above should be regarded as one possible solution, which is in no way limiting to the scope of this present invention.

What is claimed is:

1. A security system for an elevator, the security system comprising:

a car position sensor determining if a car is at a landing; and an indicator located at the landing;

wherein the indicator emits one of multiple distinct warning signals if the car is not at the landing while a landing door is closed and a person is in a related one of multiple distinct detection areas, each of the multiple distinct detection areas associated with one of the multiple distinct warning signals.

2. The security system according to claim 1 further comprising a person sensor determining if a person is in one of the multiple distinct detection areas.

3. The security system according to claim 1 further comprising a landing door sensor determining if a landing door is closed.

4. A method for warning passengers approaching an elevator landing door if an unsafe situation exists, the method comprising:

determining if a car is at a landing; and emitting one of multiple distinct warning signals at a landing at which the car is not present while a landing door at said landing is closed and a passenger is in a related one of multiple distinct detection areas, each of the multiple distinct detection areas associated with one of the multiple distinct warning signals.

5. The method according to claim 4 further comprising detecting if the passenger is in the related one of multiple distinct detection areas, wherein the one of multiple distinct warning signals is only emitted if the passenger is in the related one of the multiple distinct detection areas.

6. The method according to claim 5, wherein the multiple distinct detection areas comprise at least a first detection area and a second detection area, whereas a different warning signal is emitted depending on in which detection area the passenger is detected.

7. The method according to claim 5, wherein the one of multiple distinct warning signals is only emitted if a sojourn time of the passenger in the one of multiple distinct detection areas exceeds a predetermined duration.

8. A method for indicating an unsafe situation at elevator landing doors, the method comprising:

a. determining if a car is at a landing;

b. displaying one of multiple distinct indication signals indicating the unsafe situation at least at a landing at which the car is not present and a person is in a related one of multiple distinct detection areas, each of the multiple distinct detection areas associated with one of the multiple distinct indication signals.

9. The method according to claim 8, wherein the one of multiple distinct indication signals is displayed if the landing door is closed.

10. The method according to claim 8, wherein the one of multiple distinct indication signals is displayed without emitting acoustic signals.

* * * * *